US005456410A

United States Patent [19]

Chow

[11] Patent Number: 5,456,410

[45] Date of Patent: Oct. 10, 1995

[54] TRACK SUPPORT ASSEMBLY FOR TOY VEHICLES

[75] Inventor: Wai H. Chow, Kowloon, Hong Kong

[73] Assignee: Echo Toys Ltd., Hong Kong

[21] Appl. No.: 189,442

[22] Filed: Jan. 31, 1994

[51] Int. Cl.[6] ..... E01B 23/00

[52] U.S. Cl. ..... 238/10 R; 238/10 F; 104/125; 104/126

[58] Field of Search ..... 238/10 R, 10 A, 238/10 E, 10 F; 104/53, 60, 124, 125, 126, DIG. 1; 248/165, 185; 446/444, 446, 447

[56] References Cited

U.S. PATENT DOCUMENTS

| | | | |
|---|---|---|---|
| 2,919,515 | 6/1960 | Connell | 238/10 E |
| 3,767,114 | 10/1973 | Rossi | 238/10 E |
| 4,403,733 | 9/1983 | Bach et al. | 238/10 E |
| 4,767,053 | 8/1988 | Cook et al. | 238/10 F |
| 4,826,076 | 5/1989 | Hesse | 238/10 A |

FOREIGN PATENT DOCUMENTS

| | | | |
|---|---|---|---|
| 2078120 | 1/1982 | United Kingdom | 238/10 F |

*Primary Examiner*—David M. Mitchell
*Assistant Examiner*—S. Joseph Morano
*Attorney, Agent, or Firm*—Kirschstein, Ottinger, Israel and Schiffmiller

[57] ABSTRACT

An assembly for supporting trackway sections along which a toy vehicle is driven, includes multiple track support members for supporting single tracks and/or twin tracks, height adaptors for adjusting the height of the trackway sections relative to a support surface, and tilt adaptors for adjusting the angular orientation of the trackway sections relative to the support surface.

10 Claims, 5 Drawing Sheets

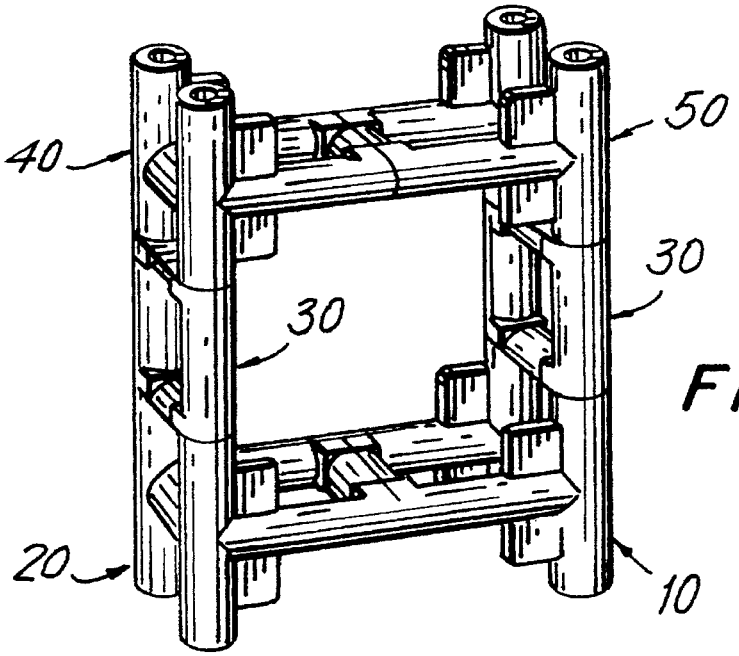
FIG. 2
FIG. 1
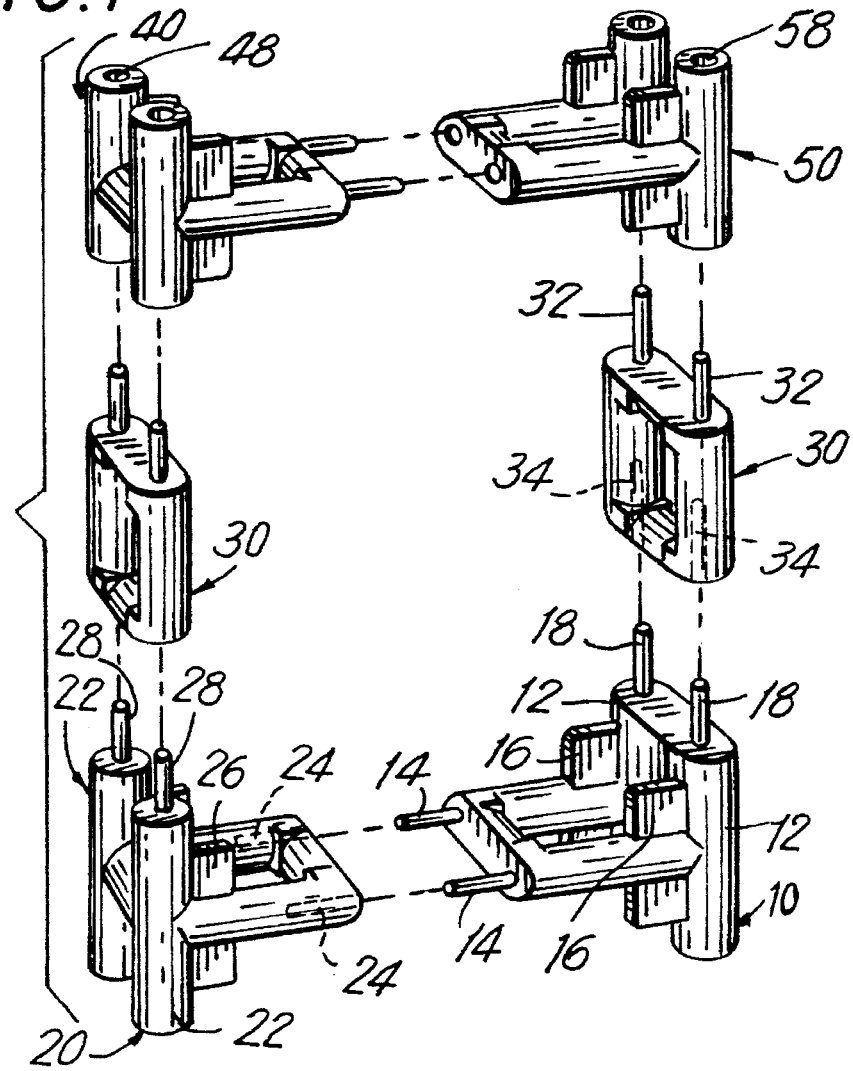

TRACK SUPPORT ASSEMBLY FOR TOY VEHICLES

BACKGROUND OF THE INVENTION

Field of the Invention

This invention generally relates to an assembly for supporting trackway sections of a track along which at least one toy vehicle is driven and, more particularly, to an assembly capable of supporting either single and/or twin tracks, at adjustable heights relative to a support surface, and at adjustable tilted orientations relative to the support surface.

Description of the Related Art

It is known to assemble tracks for toy vehicles, such as racing cars or trains, from individual, curved or straight, trackway sections. Track supports for supporting such trackway sections at a constant height above a support surface are disclosed in U.S. Pat. No. 2,919,515, and adjustable height supports are disclosed in U.S. Pat. No. 4,826,076. Although the known track supports are generally satisfactory for their intended purpose, it is desirable to increase the play value and entertainment reward of such toys.

SUMMARY OF THE INVENTION

Objects of the Invention

It is a general object of this invention to advance the state of the art of supporting toy tracks.

Another object of this invention is to provide a track support assembly capable of supporting single tracks for an extended path layout, or twin, side-by-side tracks for racing two vehicles, or both in a single layout.

Another object of this invention is to provide such an assembly capable of supporting either single or twin tracks at adjustable heights relative to a support surface.

Yet another object of this invention is to provide such an assembly capable of supporting either single or twin tracks at adjustable tilted, angular orientations relative to the support surface.

Features of the Invention

In keeping with these objects and others which will become apparent hereinafter, one feature of this invention resides, briefly stated, in an assembly for supporting above a support surface a plurality of trackway sections having identical predetermined widths and interconnected to form a track along which at least one toy vehicle is driven.

The assembly includes a first track support member and a second track support member interconnected in a detachably, interlocked state. The first member has a pair of spaced-apart, upright legs extending along a vertical direction, a pair of spaced-apart, track projections extending along a horizontal direction normal to said vertical direction, and a first track holder. The second member also has a pair of spaced-apart, upright legs extending along the vertical direction, a pair of spaced-apart, track sockets extending along the horizontal direction, and a second track holder. The track sockets of the second member receive the track projections of the first member in the interlocked state in which both pairs of legs rest on the support surface, and in which the first and second track holders are spaced apart along the horizontal direction by a distance substantially equal to the predetermined width of one of the trackway sections. Thus, a single trackway section is supported by the first and second members in the interlocked state.

The assembly further includes means for converting the first and second track support members to support two trackway sections arranged in a side-by-side relationship. The converting means includes a lane adaptor mounted between the first and second members. The lane adaptor has a pair of spaced-apart adaptor sockets for receiving the track projections of the first member, and a pair of spaced-apart adaptor projections for insertion into the track sockets of the second member. The lane adaptor extends along the horizontal direction by a distance substantially equal to the predetermined width of one of the trackway sections. Thus, by adding the lane adaptor, the assembly can accommodate twin, side-by-side tracks for racing two toy vehicles along the track.

In a preferred embodiment, the lane adaptor includes a pair of adaptor sections each extending along the horizontal direction by a distance substantially equal to one-half of said predetermined width.

The assembly further comprises a third track support member and a fourth track support member, also detachably interconnected in an interlocked state. The third member has a pair of spaced-apart, upright legs extending along the vertical direction, a pair of spaced-apart track projections extending along the horizontal direction, and a third track holder. The fourth member also has a pair of spaced-apart, upright legs extending along the vertical direction, a pair of spaced-apart, track sockets extending along the horizontal direction, and a fourth track holder. In the interlocked state, the track sockets of the fourth member receive the track projections of the third member. The legs of the third and fourth members are elevated above the legs of the first and second members. Also, the third and fourth track holders are spaced apart along the horizontal direction by a distance substantially equal to the predetermined width of one of the trackway sections.

The elevated third and fourth members are located at adjustable heights above the first and second members by a set of height adaptors. Each height adaptor extends along the vertical direction by a distance substantially equal to one-half of the predetermined width of one of the trackway sections. Each height adaptor has a pair of spaced-apart projections at one end region, and a pair of spaced-apart sockets at an opposite end region.

In one modification, the legs of the first, second, third and fourth members have connector means for connecting with the projections and sockets of a respective height adaptor. In another modification, the third and fourth members are oriented at an adjustable orientation above the first and second members by a tilt member. The tilt member has a pair of elongated arms pivotably interconnected for pivoting movement about a pivot axis extending normally of the vertical and horizontal directions. One of the arms has a first mount mounted on at least one of the first member, the second member, and the lane adaptor. The other of the arms has a second mount mounted on at least one of the third and fourth members.

Preferably, said one arm is rotatable relative to the first mount about an axis extending along the elongation of said one arm. Also, the other arm is rotatable relative to the second mount about an axis extending along the elongation of the other arm.

Another lane adaptor may be mounted between the third and fourth members and, in that case, the second mount is also mounted on said other lane adaptor.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an exploded view of a track support assembly in accordance with one embodiment of this invention;

FIG. 2 is an assembled perspective view of the assembly of FIG. 1;

DETAILED DESCRIPTION OF THE PREFERRED EMBODIMENTS

Figure 3:
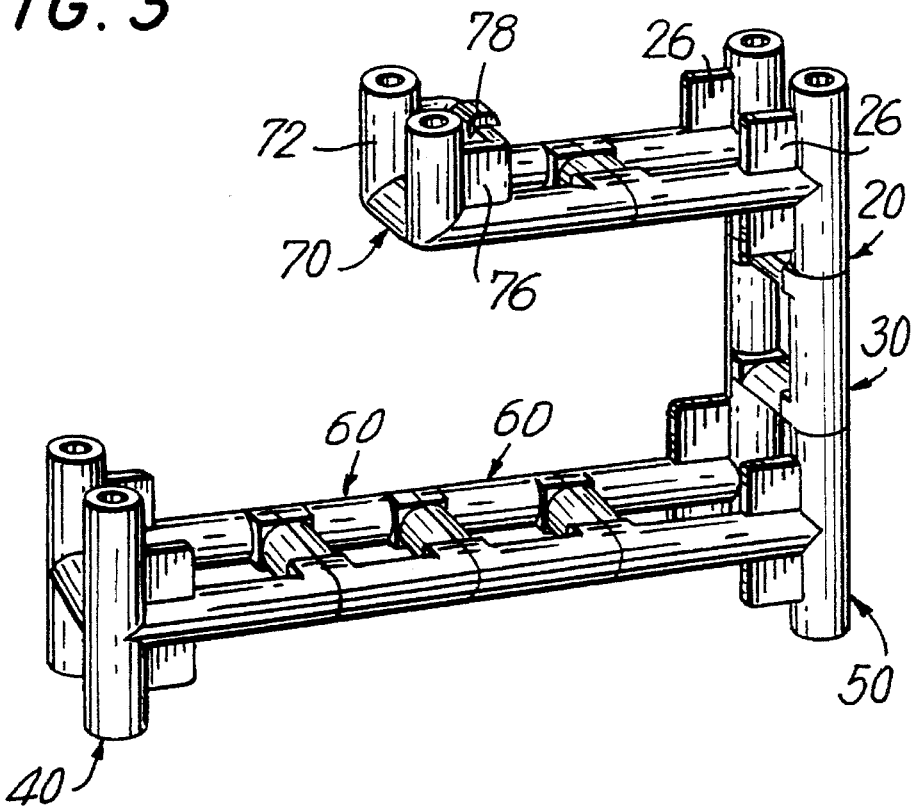
FIG. 3 is a perspective view of a modified assembly in accordance with another embodiment of this invention.

Referring now to FIG. 1 of the drawings, reference numeral 10 generally identifies a first track support member having a pair of transversely spaced-apart, upright legs 12 extending along a vertical direction, a pair of transversely spaced-apart, track projections 14 extending along a horizontal direction, a pair of first track holders 16, and a pair of transversely spaced-apart, upright pins 18 extending along the vertical direction from the upper ends of the legs 12. A second track support member 20 has a pair of transversely spaced-apart, upright legs 22 extending along the vertical direction, a pair of transversely spaced-apart, track sockets 24 extending along the horizontal direction, a pair of transversely spaced-apart, second track holders 26, and a pair of transversely spaced-apart, upright pins 28 extending along the vertical direction from the upper ends of the legs 22.

As shown in the detachable, interlocked state of FIG. 2, the projections 14 are friction tightly inserted into the sockets 24 to form a rigid structure. The legs 12, 22 are located at the four corners of the structure for stability, and rests on a non-illustrated support surface such as a table top. The horizontal distance between the first and second track holders 16, 26 is substantially equal to the predetermined width of a single trackway section. As explained below, one such section is laid between the holders 16, 26 which friction tightly hold the trackway section in place.

As described so far, a single trackway section is supported above the support surface, and additional first and second members 10, 20 are arranged upstream and downstream of the trackway section in order to create any desired layout. For greater play value, trackway sections can be arranged at higher elevations and, to that end, height adaptors 30 are used. Each height adaptor 30 includes a pair of transversely spaced-apart projections 32 at an upper end region, and a pair of transversely spaced-apart sockets 34 at a lower end region. Each height adaptor 30 is a four-sided structure. The pins 18, 28 of the members 10, 20 are respectively inserted into the complementary sockets 34. Each height adaptor 30 extends for a vertical distance substantially equal to one-half of the aforementioned predetermined width. Any number of height adaptors can be stacked, one above another, to achieve the desired height for additional trackway sections.

As shown in FIG. 1, a third track support member 40 is identical to the first member 10, except that the upper pins 18 have been replaced by sockets 48. A fourth track support member 50 is identical to the second member 20, except that the upper pins 28 have been replaced by sockets 58. The non-illustrated lower ends of the members 10, 20, 40 and 50 are all provided with sockets, identical to sockets 34 of each height adaptor 30. As shown in the assembled view of FIG. 2, a single track can be supported on the lower interconnected members 10, 20, while another single track can be supported on the upper interconnected members 40, 50 and, as previously noted, the height of the upper members 40, 50 relative to the lower members 10, 20 is selected at a user's option by choosing an appropriate number of height adaptors 30.

For even greater play value, the trackway sections can be arranged in a side-by-side relationship for racing two toy vehicles on a twin track and, to that end, lane adaptors 60, as shown in FIG. 3 are used. Each lane adaptor 60 is identical to the above-described height adaptor 30 and, hence, a detailed description of the lane adaptor is not necessary. Since each lane adaptor is equal to one-half the predetermined width of a single trackway section, a pair of such lane adaptors 60 are mounted between any two track support members, such as 40 and 50, in order to accommodate a second trackway section at a lower level. Of course, the lane adaptors 60 could equally well have been placed between any two track support members at an upper level.

FIG. 3 also discloses a fifth track support member 70 similar to the third member 40, except in two respects. First, the legs 72 extend along the vertical direction from only one side of the member 70, rather than from both sides of the member. Thus, as best seen in the front elevation of FIG. 4, the member 70 has an L-shaped configuration, rather than a T-shaped configuration exhibited by member 40. Secondly, a track holder 76 for member 70 is provided with a snap-action flange 78.

Figure 4:
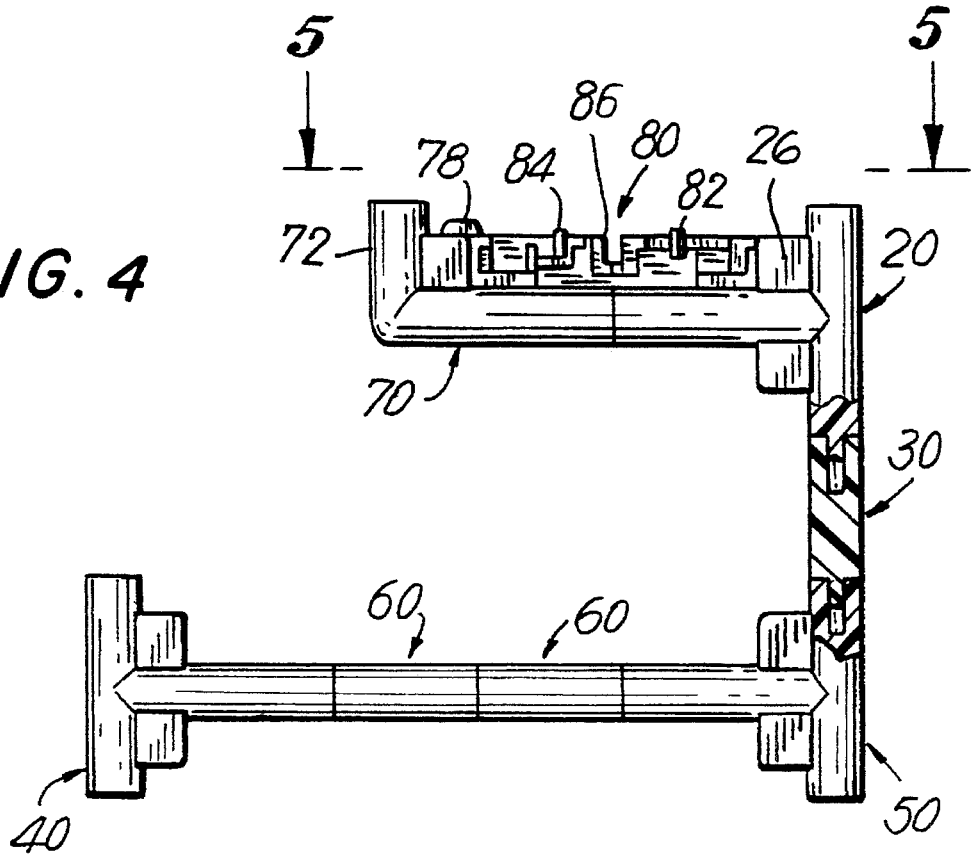
FIG. 4 is a partly sectioned, front elevational view of the assembly of FIG. 3.
Figure 5:
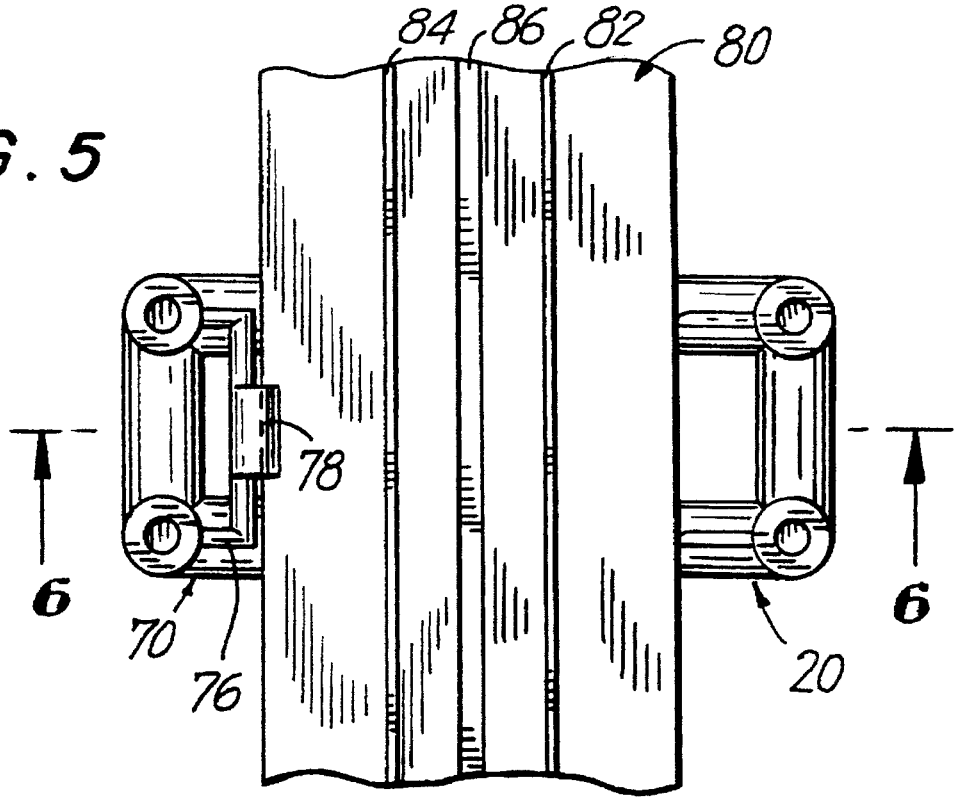
FIG. 5 is a top plan view taken along line 5—5 of FIG. 4.
Figure 6:
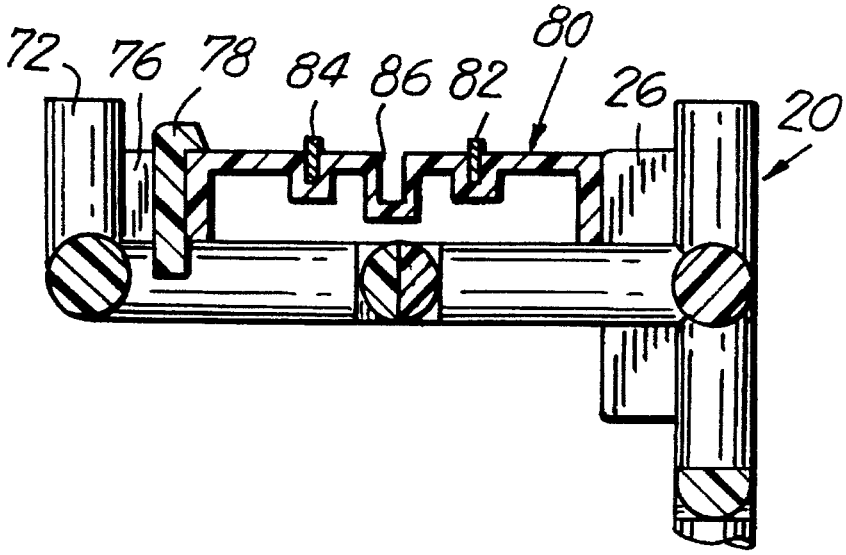
FIG. 6 is a sectional view taken on line 6—6 of FIG. 5.

As shown in FIGS. 4 through 6, a single trackway section 80 having a predetermined width, on the order of about 4 centimeters, is laid on a pair of upper track support members 20, 70 and friction tightly held in place with track holders 26, 76. The flange 78 extends over an upper surface of the trackway section 80 to more firmly anchor the trackway section in place. Trackway section 80 is entirely conventional and may be straight or curved. As shown, section 80 has a power rail and a ground rail 82, 84 connected to a non-illustrated electrical power source to power a conventional electric toy vehicle having a depending guide lug which is mounted in and along a central guide channel 86 formed in the section 80 in order to maintain the toy vehicle on the track.

Figure 8:
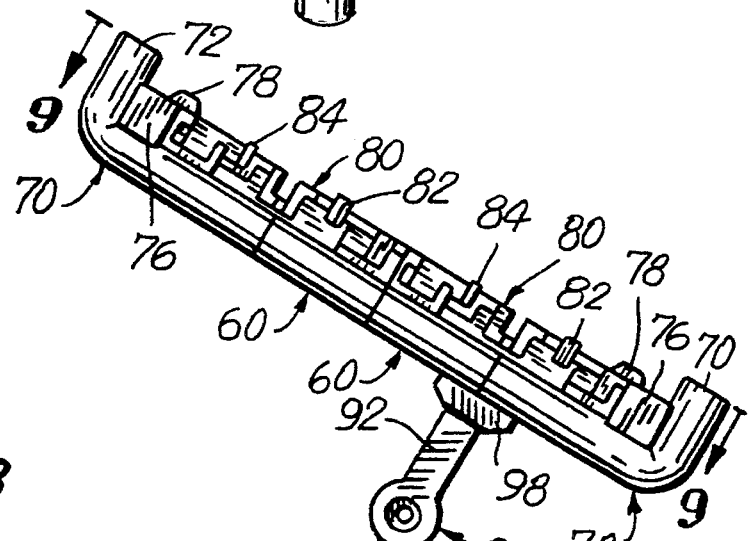
FIG. 8 is a partly sectioned, front elevational view of the assembly of FIG. 7.
Figure 9:
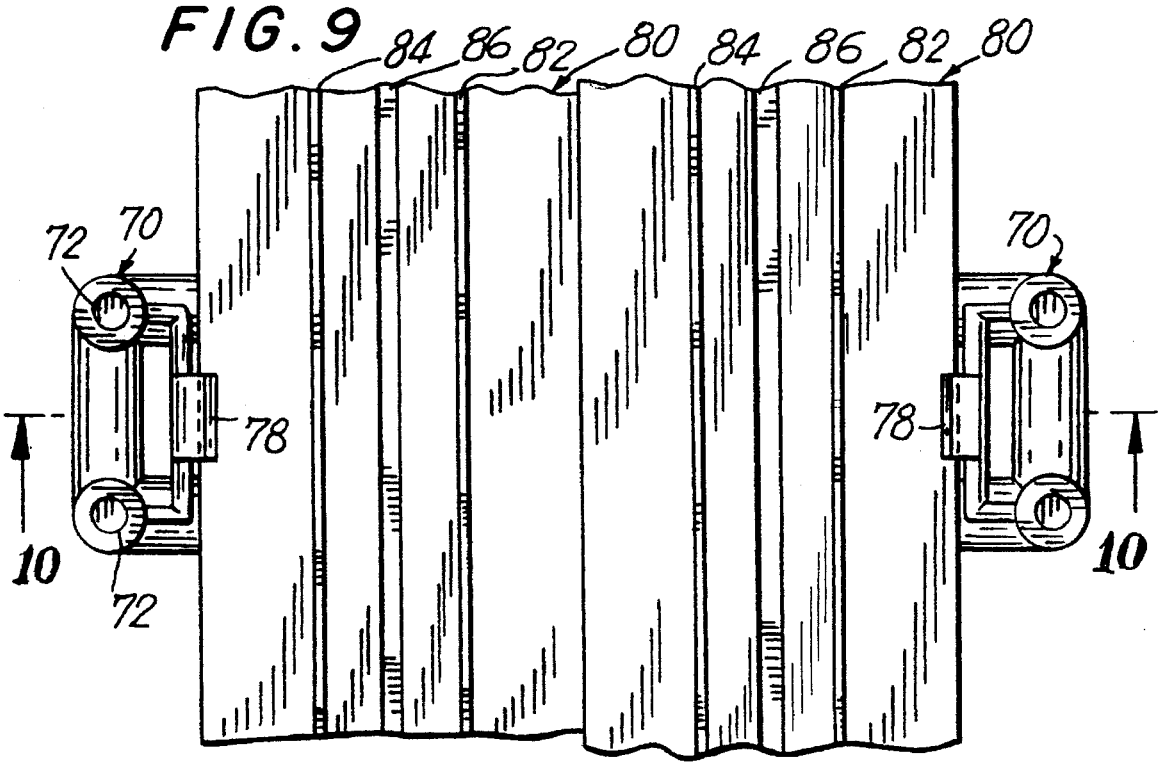
FIG. 9 is a top plan view taken on line 9—9 of FIG. 8.
Figure 10:
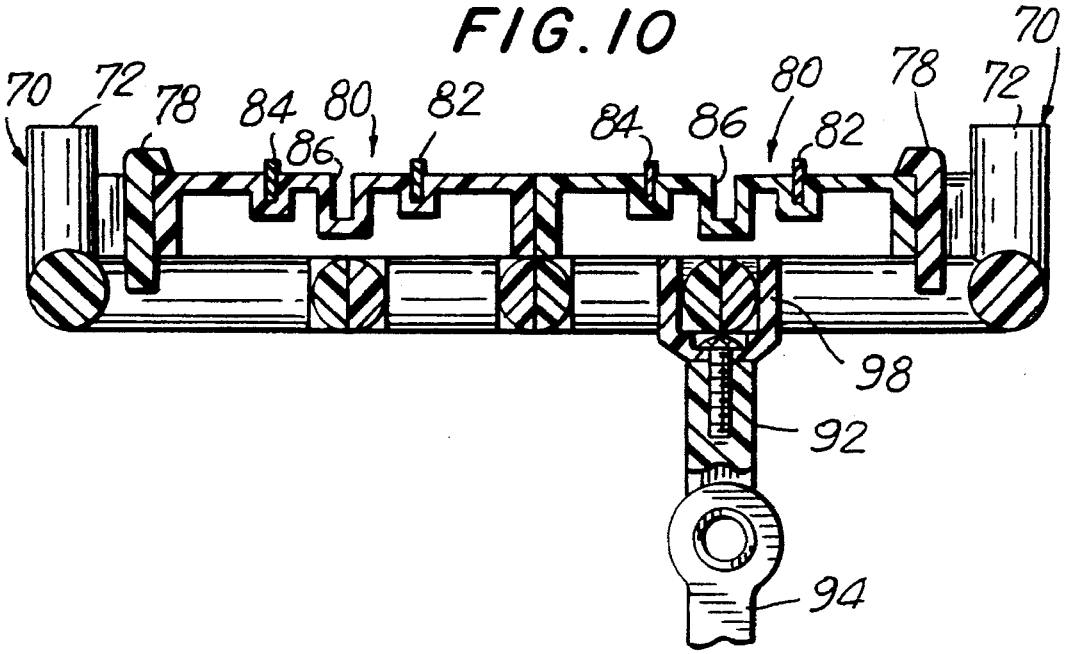
FIG. 10 is a sectional view taken on line 10—10 of FIG. 9.

The member 70 is particularly suited for supporting trackway sections at adjustable angular orientations above the support surface, especially when the trackway sections are not parallel to the support surface, i.e., in the case of steeply banked trackway sections. As shown in FIGS. 8 through 10, two trackway sections 80 are arranged in a side-by-side relationship and held in place by a pair of snap-action flanges 78 from a pair of fifth supporting members 70 and a pair of lane adaptors 60. The trackway sections are elevated above other track support members by a tilt member 90. Tilt member 90 has a pair of elongated arms 92, 94 pivotably interconnected for pivoting movement about a pivot axis 96 extending normally of the vertical and horizontal directions. Arm 92 has a rotary mount 98 rotatable in either circumferential direction about an axis extending along the elongation of the arm 92. Likewise, arm 94 has a rotary mount 100 rotatable in either circumferential direction about the elongation of arm 94. Each mount includes spaced-apart fingers for friction tightly gripping adjacent portions of the track support members and adaptors. Thus, as illustrated for exemplary purposes, each mount 98, 100 grips adjacent portions of adaptor 60 and member 70. Such adjacent portions are advantageously rounded, as best shown in FIG. 10, wherein the mount 98 grips adjacent semi-circular portions of adaptor 60 and member 70.

Figure 7:
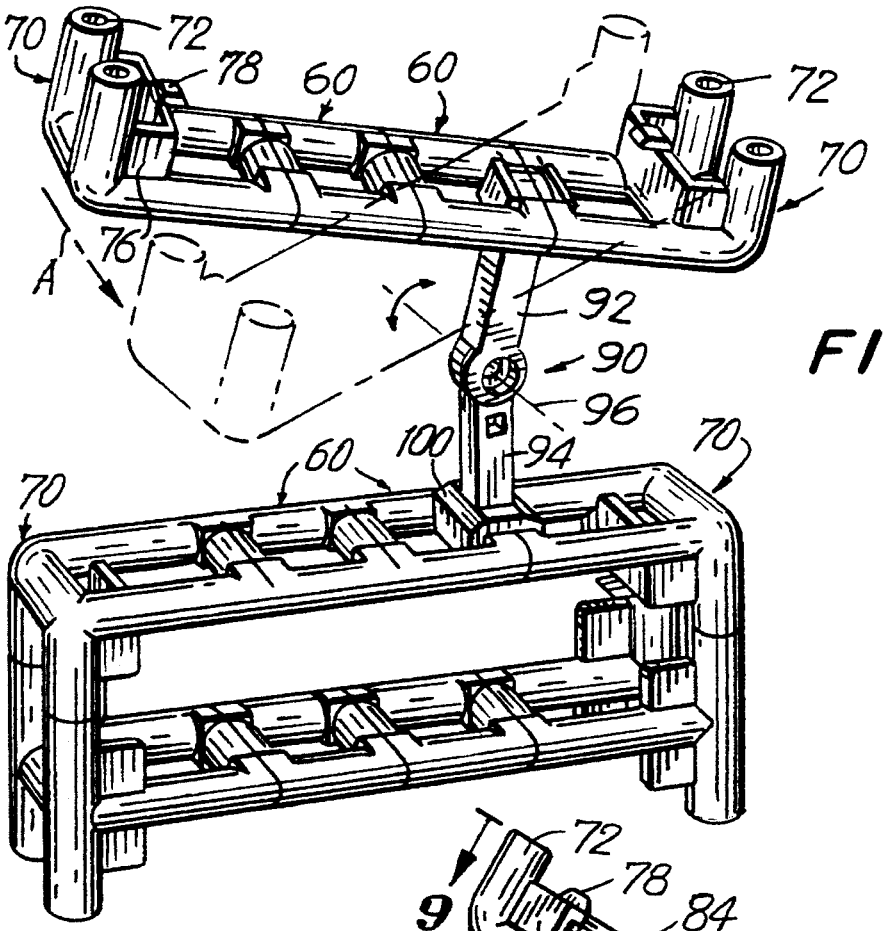
FIG. 7 is a perspective view of another modified assembly in accordance with yet another embodiment of this invention.

Thus, as illustrated in FIG. 7, a pair of trackway sections are elevated well above the support surface at an upper level and may be steeply banked to any angular orientation by tilting the assembly of interconnected adaptors 60 and members 70 in either circumferential direction about pivot axis 96 and, in addition, may be turned, for example, to the phantom line position in the direction of the arrow A. Each track support member is constructed of a molded synthetic plastic material.

It will be understood that each of the elements described above, or two or more together, also may find a useful application in other types of constructions differing from the types described above.

While the invention has been illustrated and described as embodied in track support assembly for toy vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An assembly for supporting above a support surface a plurality of trackway sections having identical predetermined widths and interconnected to form a track along which at least one toy vehicle is driven, comprising:

a) a first track support member having a pair of spaced-apart, upright legs extending along a vertical direction, a pair of spaced-apart, track projections extending along a horizontal direction normal to said vertical direction, and a first track holder;

b) a second track support member having a pair of spaced-apart, upright legs extending along the vertical direction, a pair of spaced-apart, track sockets extending along the horizontal direction, and a second track holder, said track sockets of the second member receiving the track projections of the first member in a detachably, interlocked state in which both pairs of legs rest on the support surface, and in which the first and second track holders are spaced-apart along the horizontal direction by a distance substantially equal to the predetermined width of one of the trackway sections; and c) means for converting the first and second track support members to support two trackway sections arranged in a side-by-side relationship, including a lane adaptor mounted between the first and second members and having a pair of spaced-apart adaptor sockets for receiving the track projections of the first member, and a pair of spaced-apart adaptor projections for insertion into the track sockets of the second member, said lane adaptor extending along the horizontal direction by a distance substantially equal to the predetermined width of one of the trackway sections.

2. The assembly according to claim 1, wherein the lane adaptor includes a pair of adaptor sections each extending along the horizontal direction by a distance substantially equal to one-half of the predetermined width of one of the trackway sections.

3. The assembly according to claim 1; and further comprising a third track support member having a pair of spaced-apart, upright legs extending along the vertical direction, a pair of spaced-apart, track projections extending along the horizontal direction, and a third track holder; a fourth track support member having a pair of spaced-apart, upright legs extending along the vertical direction, a pair of spaced-apart track sockets extending along the horizontal direction, and a fourth track holder, said track sockets of the fourth member receiving the track projections of the third member in a detachably interlocked state in which the legs of the third and fourth members are elevated above the legs of the first and second members, and in which the third and fourth track holders are spaced apart along the horizontal direction by a distance substantially equal to the predetermined width of one of the trackway sections.

4. The assembly according to claim 3; and further comprising means for elevating the third and fourth members at an adjustable height above the first and second members, including a set of height adaptors each extending along the vertical direction by a distance substantially equal to one-half of the predetermined width of one of the trackway sections, each height adaptor having a pair of spaced-apart projections at one end region, and a pair of spaced-apart sockets at an opposite end region.

5. The assembly according to claim 4, wherein the legs of the first, second, third and fourth members have connector means for connecting with the projections and sockets of a respective height adaptor.

6. The assembly according to claim 3; and further comprising means for orienting the third and fourth members at an adjustable orientation above the first and second members, including a tilt member having a pair of elongated arms pivotably interconnected for pivoting movement about a pivot axis extending normally of the vertical and horizontal directions, one of the arms having a first mount mounted on at least one of the first member, the second member and the lane adaptor, and the other of the arms having a second mount mounted on at least one of the third and fourth members.

7. The assembly according to claim 6, wherein said one arm is rotatable relative to the first mount about an axis extending along the elongation of said one arm, and wherein said other arm is rotatable relative to the second mount about an axis extending along the elongation of said other arm.

8. The assembly according to claim 6; and further comprising another lane adaptor mounted between the third and fourth members and having a pair of spaced-apart adaptor sockets for receiving the track projections of the third member, and a pair of spaced-apart adaptor projections for insertion into the track sockets of the fourth member, said other lane adaptor extending along the horizontal direction by a distance substantially equal to the predetermined width of one of the trackway sections; and wherein the second mount is mounted on said other lane adaptor.

9. The assembly according to claim 3, wherein each track support member is constituted of a molded synthetic plastic material.

10. The assembly according to claim 3, wherein at least one of the track support members has a snap-action flange.

* * * * *